US010219624B2

(12) United States Patent
Brandhuber

(10) Patent No.: US 10,219,624 B2
(45) Date of Patent: Mar. 5, 2019

(54) SEATING/RECLINING-FURNITURE

(71) Applicant: himolla Polstermöbel GmbH, Taufkirchen / Vils (DE)

(72) Inventor: Robert Brandhuber, Neufraunhofen (DE)

(73) Assignee: HIMOLLA POLSTERMÖBEL GMBH, Taufkirchen/Vils (DE)

( * ) Notice: Subject to any disclaimer, the term of this patent is extended or adjusted under 35 U.S.C. 154(b) by 0 days.

(21) Appl. No.: 15/482,128

(22) Filed: Apr. 7, 2017

(65) Prior Publication Data

US 2017/0332787 A1 Nov. 23, 2017

(30) Foreign Application Priority Data

Apr. 8, 2016 (DE) ..... 10 2016 106 477

(51) Int. Cl.
*A47C 7/50* (2006.01)
*A47C 1/0355* (2013.01)
*A47C 1/034* (2006.01)

(52) U.S. Cl.
CPC ..... *A47C 1/0355* (2013.01); *A47C 1/0342* (2013.01); *A47C 7/506* (2013.01)

(58) Field of Classification Search
CPC ..... A47C 7/50; A47C 7/506; A47C 1/0355; A47C 1/0345
See application file for complete search history.

(56) References Cited

U.S. PATENT DOCUMENTS

2002/0113477 A1* 8/2002 Uchiyama ..... A47C 1/0242 297/330
2002/0149238 A1* 10/2002 Hoffman ..... A47C 1/03255 297/85 R
2004/0012231 A1* 1/2004 Hesse ..... A47C 1/0355 297/85 M
2008/0012405 A1 1/2008 Dewert
(Continued)

FOREIGN PATENT DOCUMENTS

DE 3718645 A1 3/1988
DE 102005001875 A1 7/2006
(Continued)

OTHER PUBLICATIONS

Communication received from the German Patent Office; dated Jan. 25, 2017; 2 pages.
(Continued)

*Primary Examiner* — Timothy J Brindley
(74) *Attorney, Agent, or Firm* — Cantor Colburn LLP

(57) ABSTRACT

The invention relates to seating/reclining furniture, in particular to an armchair or chair, having a back part, a seat part and an adjustable footrest arrangement that is pivotable between an inwardly folded base position beneath a seating surface and an outwardly folded position of use relative to the seat part, wherein the footrest arrangement comprises a frame that is a component of the seat part or is attached to the seat part and a footrest pivotable relative to the frame, and wherein the footrest has a base part and an extension that is movable relative to the base part between the base position and the position of use, such that the footrest is shorter in an intermediate position than in the position of use and in the base position.

23 Claims, 6 Drawing Sheets

(56) References Cited

U.S. PATENT DOCUMENTS

| | | | | |
|---|---|---|---|---|
| 2011/0043005 | A1* | 2/2011 | Fischer | A47C 7/506 297/68 |
| 2011/0298249 | A1* | 12/2011 | Kuno | A47C 7/506 297/75 |
| 2014/0049078 | A1* | 2/2014 | Hortig | A47C 1/034 297/68 |
| 2014/0292052 | A1* | 10/2014 | Parker | A47C 7/38 297/342 |
| 2015/0021969 | A1* | 1/2015 | Yin | B64D 11/0643 297/423.26 |
| 2015/0305507 | A1* | 10/2015 | Besler | A47C 7/506 297/423.28 |
| 2016/0045031 | A1* | 2/2016 | Lawson | A47C 1/0345 297/284.3 |
| 2017/0296410 | A1* | 10/2017 | Feldman | A61G 5/14 |

FOREIGN PATENT DOCUMENTS

| | | | |
|---|---|---|---|
| DE | 202009011078 | U1 | 12/2009 |
| DE | 102013208562 | A1 | 11/2014 |

OTHER PUBLICATIONS

Search Report from European Patent Office for related European Application No. 17165239.9 dated Sep. 6, 2017; 3 pages.

* cited by examiner

SEATING/RECLINING-FURNITURE

CROSS-REFERENCES TO RELATED APPLICATIONS

This patent application claims the priority of German Application No. 102016106477.7, filed Apr. 8, 2016, which is incorporated by reference in its entirety.

The invention relates to seating/reclining furniture, in particular to an armchair or chair, having a back part, a seat part and an adjustable footrest arrangement that is pivotable between an inwardly folded base position beneath a seating surface and an outwardly folded position of use relative to the seat part, wherein the footrest arrangement comprises a frame that is a component of the seat part or is attached to the seat part and a footrest pivotable relative to the frame.

Such furniture is generally known. The pivotable footrest should provide a support surface that is as large, i.e. as long, as possible in the outwardly folded position of use so that even relatively tall persons have a complete foot support available. At the same time, the footrest should be able to be stowed away in as compact and easy a manner as possible beneath the seat part in an inwardly folded base position.

What is problematic here is in particular the relatively small clearance, that is the free area between the floor on which the furniture stands and the lower side of the seat part in the region of the front edge of the seat part. The desired useful length of the footrest in the outwardly folded position of use is practically always larger than this clearance. Multi-part footrests are therefore already known that are pivoted out of the base position in a state corresponding to the base position in which the parts of the footrest are pushed together, folded together, moved inward or folded inward, wherein the parts forming the footrest are again moved apart after reaching the outwardly folded position of use. This can e.g. take place directly manually or indirectly via a fitting that can in turn be actuated either manually or in a powered manner.

This adjustment of the footrest can be accompanied by an adjustment movement of the seat part and in particular also of the back part. It is namely desirable in practice that the footrest is outwardly folded in a so-called relaxation or rest position of the piece of furniture in which the seat part is lowered in the rear region and thus provides a seating surface with a greater inclination, with the backrest formed by the back part additionally likewise having a greater inclination in this relaxation or rest position than in the base position of the furniture.

Such footrests have to date been provided with a separate cover or with separate upholstery that is not connected to the cover or to the upholstery of the seat part. The individual parts of multi-part footrests are also separately covered or upholstered. It is ensured in this manner that the cover or the upholstery is not impaired in that the footrest is pivoted relative to the seat part and the individual parts are additionally moved relative to one another with a multi-part footrest. A disturbing fall of the folds of the cover or of the upholstery can thus in particular not occur in the inwardly folded base position.

It is the object of the present invention to further develop a piece of seating/reclining furniture of the initially named kind such that a footrest is provided even with a comparatively small clearance which has a support surface which is as large as possible and in which in addition no restrictions are present with respect to the further features, in particular with respect to cover or upholstery possibilities.

This object is satisfied by the features of claim 1 and in particular in that the footrest has a base part and an extension that is movable relative to the base part between the base position and the position of use such that the footrest is shorter in an intermediate position than in the position of use and in the base position.

The footrest in accordance with the invention has a larger length in the inwardly folded base position than in the intermediate position. The invention is thus based on the recognition that the length of the footrest does not necessarily have to be minimal in the inwardly folded base position. It has rather been recognized that, so-to-say, the "bottleneck" is that pivot position of the footrest in which the footrest is at least substantially oriented in the perpendicular since the clearance present at the respective piece of furniture has the greatest effect in this position.

The invention thus makes it possible to shorten or contract the footrest or to move it inward during the outward pivoting and inward pivoting such that the "restriction" given by the clearance can be moved through without problem. This in turn opens up the possibility of providing the total footrest, optionally including the seat part, with a common, continuous cover or with common, continuous upholstery. A fall of the folds of the cover or of the upholstery that may occur with a contracted footrest is not problematic in accordance with the invention since this effect only occurs temporarily during the outward pivoting or the inward pivoting. While this problem is anyway not present in the outwardly folded position of use, it can, however, be ensured by the invention that a fall of the folds or similar disturbing effects that may occur due to the required shortening of the footrest are also not problematic in the inwardly folded base position. A tautening or smoothing of the cover or of the upholstery is achieved in accordance with the invention by the larger length of the footrest in the base position in comparison with the intermediate position.

The invention consequently also enables a continuous cover or a continuous upholstery with multi-part footrests having an extensible and retractable extension even when the footrest has a comparatively large useful length in the outwardly folded position of use such as is increasingly expected by customers and when the footrest has to be comparatively greatly shortened due to a relatively small clearance to be able to be outwardly folded and inwardly folded.

Advantageous embodiments of the invention are set forth in the following and are also disclosed in the dependent claims, in the Figures and in their description.

Provision is preferably made that the length of the footrest is minimal in the intermediate position.

Provision can be made that the extension is retractable and extensible relative to the base part.

Provision is preferably made that the extension is extended less far in the base position than in the position of use.

Provision is made in an embodiment that the base part and the extension are each configured in board form or at least comprise a board-like support element.

Provision can be made that the base part and the extension together form an at least substantially continuous support in the position of use.

Provision is preferably made that the footrest is provided with a continuous cover or with continuous upholstery.

Provision is made in an embodiment that the footrest is extended with respect to the intermediate position in the base position such that a cover or upholstery of the footrest is tautened or tightened more than in the intermediate position.

A further development provides that the footrest is pivotable about a pivot axis that extends in the region of a front edge of the seat part.

Provision is made in an embodiment that the footrest is attached to the frame in a manner pivotable over the base part.

Provision is preferably made that the footrest is pivotable by means of a powered or manual drive.

Provision can be made that an adjustment of the seat part is provided as the drive for the pivot movement of the footrest and/or that the pivot movement of the footrest is derived from an adjustment movement of the seat part.

Provision is made in an embodiment that the seat part is supported at a carrier and is adjustable relative to the carrier, with a front pivot lever arrangement and a rear pivot lever arrangement in particular being provided to support and adjust the seat part.

Provision can be made that a pivot mechanism is provided for the inward folding and outward folding of the footrest that is likewise coupled to the seat part, on the one hand, and that is coupled to the base part of the footrest, on the other hand, and is supported at the carrier therebetween.

Provision is preferably made that an adjustment movement of the seat part is superposed on the pivot movement of the footrest, with a front region of the seat part in particular being raised with respect to the base position in the intermediate position of the footrest.

A further development provides that the movement of the extension relative to the base part is derived from a pivot movement of the base part.

Provision can be made that an adjustment arrangement is provided for the extension that acts between the extension and the frame.

Provision is preferably made that the base part is pivotable about a pivot axis relative to the frame and that the adjustment arrangement is connected to the frame in an articulated manner about an adjustment axis.

Provision is made in an embodiment that the pivot axis and the adjustment axis extend with a parallel offset from one another, with the adjustment axis in particular extending beneath the pivot axis, and preferably at least substantially vertically beneath the pivot axis.

A further development provides that the spacing between the pivot axis and the adjustment axis is unchanged during the pivot movement of the footrest.

Provision can be made that the pivot axis and the adjustment axis are each in a fixed position with respect to the frame.

Provision is preferably made that the pivot axis and the adjustment axis define a plane that extends at least substantially vertically and/or in parallel with the footrest located in the intermediate position and/or that is oriented relative to the footrest located in the intermediate position such that the adjustment arrangement sets the length of the footrest to a minimum in the intermediate position.

Provision is made in an embodiment that the adjustment arrangement comprises an at least two-armed swivel lever that is connected between the frame and the extension and that is attached to the base part rotatable about an axis of rotation, with the axis of rotation in particular extending perpendicular to the pivot axis of the base part and/or perpendicular to a support surface defined by the base part.

Provision can be made that an effective length of the adjustment arrangement varies between the base position and the position of use of the footrest and in particular passes through an extreme value, in particular a maximum value.

Provision is preferably made that the adjustment arrangement comprises a control member that is connected to the frame, that is variable in its effective length between the base position and the position of use of the footrest, and a conversion member that is connected to the base part and to the extension and is coupled to the control member and converts a change in the effective length of the control member into a movement of the extension relative to the base part, with a shortening of the effective length of the control member in particular being converted into an increase in the length of the footrest and vice versa.

A further development provides that the conversion member comprises an at least two-armed swivel lever that is attached to the base part rotatable about an axis of rotation, with the axis of rotation in particular extending perpendicular to the pivot axis of the base part and/or perpendicular to a support surface defined by the base part.

The invention additionally relates to an adjustable footrest arrangement, in particular for seating/reclining furniture of the above-described kind, that is pivotable between an inwardly folded base position and an outwardly folded position of use, wherein the footrest arrangement comprises a frame and a footrest pivotable relative to the frame, and wherein the footrest has a base part and an extension that is movable between the base position and the position in use relative to the base part such that the footrest is shorter in an intermediate position than in the position of use and in the base position.

In possible further developments, the footrest arrangement in accordance with the invention can have one or more features of the footrest arrangement described above in connection with the seating/reclining furniture in accordance with the invention.

The invention will be described in the following by way of example with reference to the drawing.

Figure 1:
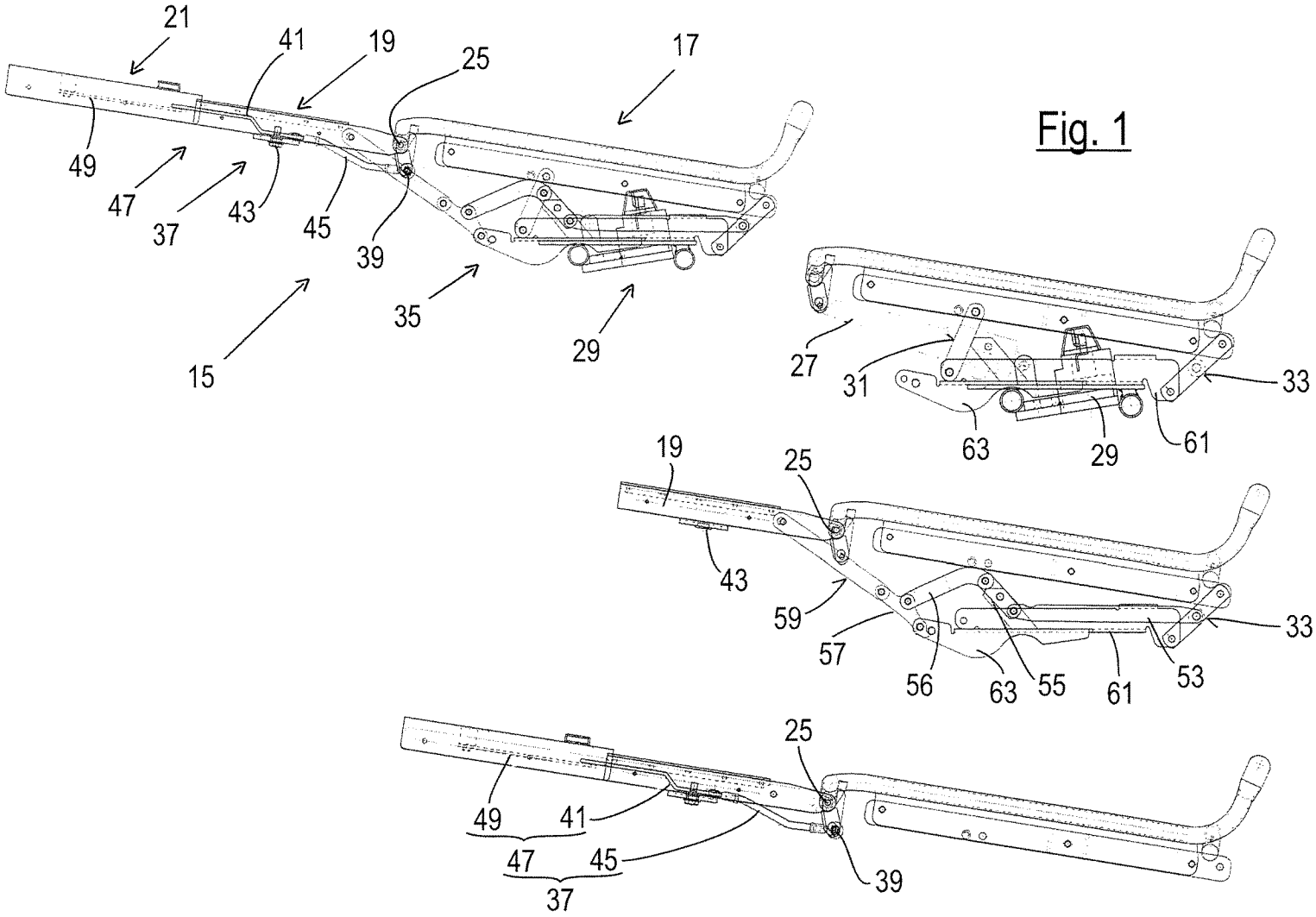
FIG. 1 shows different views of a footrest arrangement accordance with the invention.
Figure 2:
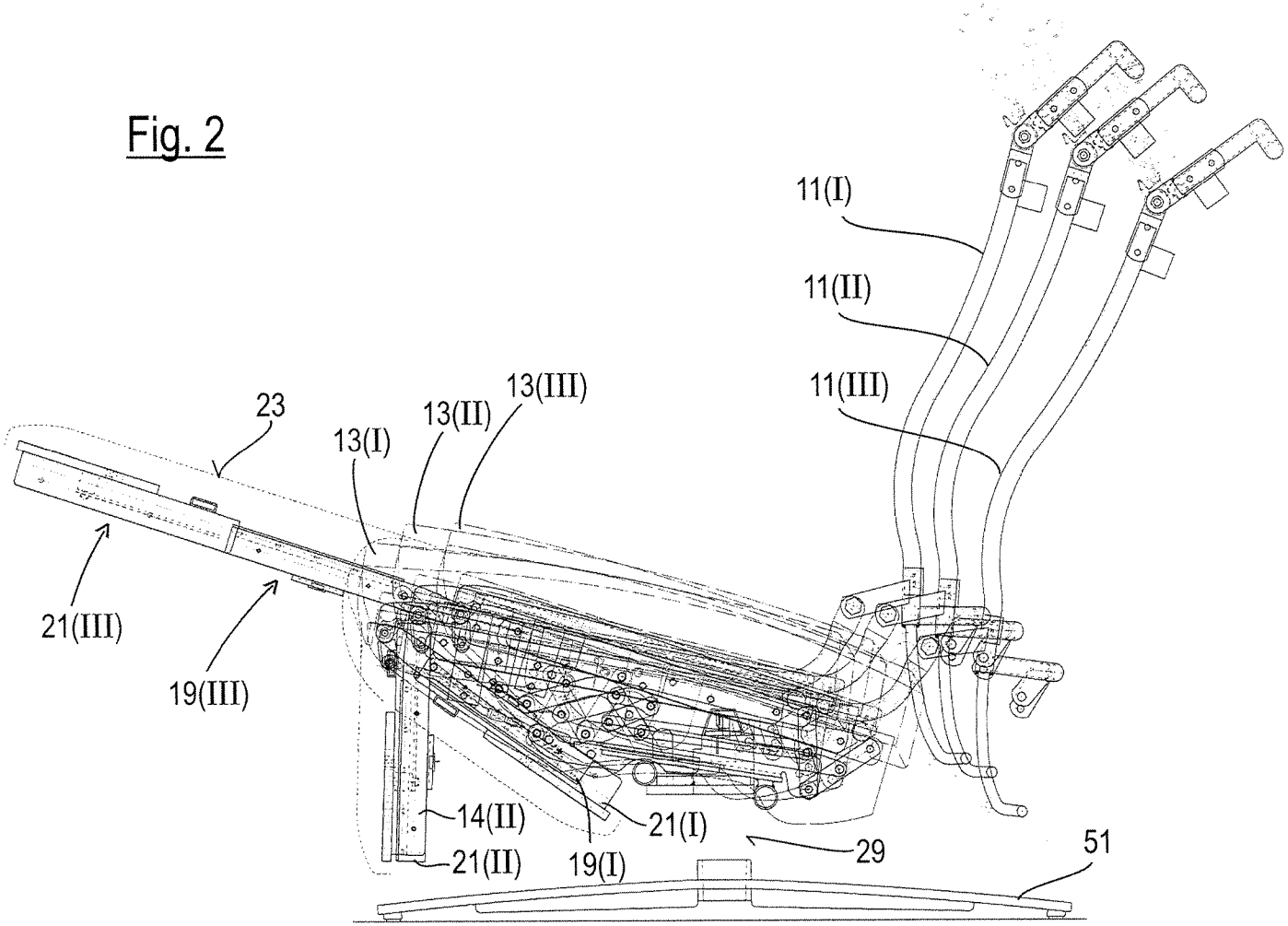
FIG. 2 shows a total overview of the furniture in accordance with the invention in a base position I, an intermediate position II and in a position of use III.

While FIG. 2 shows a total overview with the relevant individual components of the furniture in accordance with the invention simultaneously in the base position I, in an intermediate position II and in the position of use III, the concept of the pivotable footrest should first be explained with reference to FIG. 1.

FIG. 1 shows different views of a footrest arrangement 15 that inter alia comprises a frame 17 that forms a part of the seat part 13 (FIG. 2) or is fastened to the lower side of the seat part 13. The frame 17 or a part of the frame serving as the base for movable components and the seat part 13 are not movable relative to one another in this embodiment and thus behave as a unit in a kinematic regard.

In all the representations of FIG. 1, the footrest arrangement 15 is shown with an outwardly folded foot rest located in the position of use, wherein only some of the respective components relevant here are shown in the three right hand representations.

The footrest comprises a base part 19 that is pivotable about an axis 25 relative to the frame 17. An extension is displaceably supported relative to the base part 19. The extension 21 can be retracted or pulled in and extended or pulled out. A so-called full extension is provided for the guide between the base part 19 and the extension 21.

As FIG. 2 shows, the seat part 13 together with the footrest arrangement 15 is supported at a foot 51 of the piece of furniture via a carrier 29 that comprises a support column not shown in FIG. 1 as well as a head section of which two carrier parts 61, 63 are shown in the middle right hand representation in FIG. 1 and further components, not designated in more detail here, are shown in the representation thereabove.

An electric motor 27 is connected between the frame 17 and the carrier 29. The frame 17 can be adjusted by means of the motor 27 relative to the carrier 29 between the position of relaxation shown in FIG. 1, that corresponds to the outwardly folded position of use of the footrest, and a base position not shown here. The frame 17 is coupled for this purpose to the carrier part 61 with a front pivot lever arrangement 31 and with a rear pivot lever arrangement 33. The frame 17 is shown lowered in the rear region in the position of relaxation shown in FIG. 1. This can also be recognized in FIG. 2.

The adjustment of the frame 17 and thus of the seat part 13 effects the pivoting of the base part 19 of the footrest, and indeed via a pivot mechanism 35. The rear pivot lever arrangement 33 connected in an articulated manner to the carrier part 61 actuates a connecting rod arrangement 53 that actuates a pivotably supported two-armed deflection lever 55 that in turn actuates an angled pivot lever 56. The pivot lever 56 is connected in an articulated manner to a further pivot lever 57, and indeed in a region between the articulated connection of this pivot lever 57 to the carrier part 63, on the one hand, and an articulated connection of this pivot lever 57 to a further pivot lever 59, on the other hand. The last-named pivot lever 59 is in turn finally connected in an articulated manner to the base part 19. Instead of one single lever, a respective lever arrangement can be provided with two or more single levers active in parallel.

Figure 6:
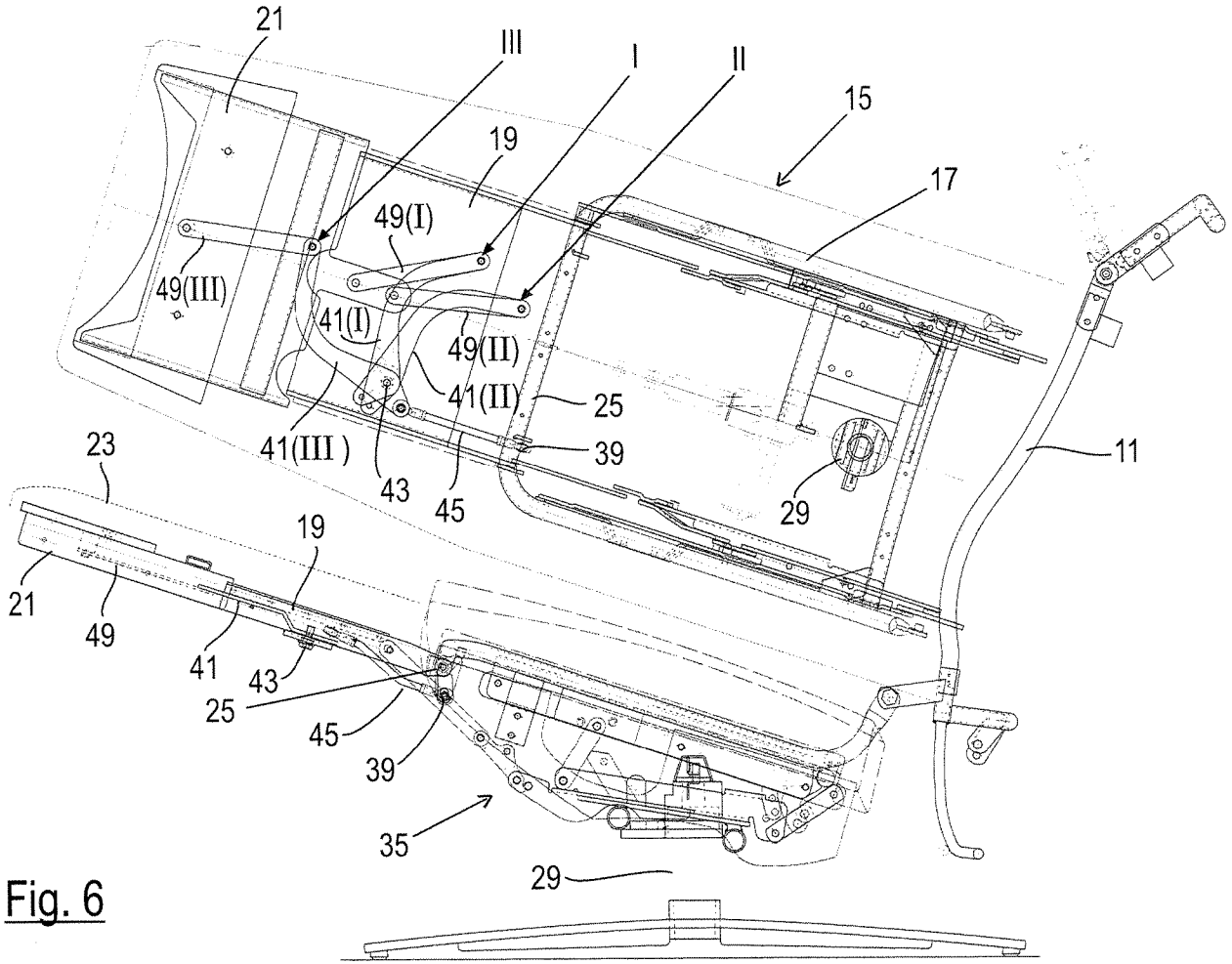
FIG. 6 shows in the upper representation a top view onto a footrest arrangement accordance with the invention, and in the lower representation a side view of the furniture in accordance with the invention in a position of use III.

The adjustment of the frame 17 thus controls the pivot movement of the base part 19 and thus of the footrest in its totality. The moving out and moving in of the extension 21, in contrast, is derived from the pivot movement of the base part 19. An adjustment arrangement 37 is provided for this purpose. Reference is also made to the representations in FIG. 6 in this respect.

The adjustment arrangement 37 comprises an elongated control member 35 that is provided in the form of a bar and that is connected in an articulated manner to the frame 17, on the one hand, and is connected to a two-armed swivel lever 41, on the other hand, that is a component of a conversion member 47.

The adjustment axis 39 about which the control bar 45 can pivot relative to the frame 17 extends in parallel with the pivot axis 25 of the base part 19, but at a spacing from this pivot axis 25 in so doing. The adjustment axis 39 is arranged beneath the pivot axis 25, with the two axes 25, 39 being disposed in a plane that extends approximately vertically.

This embodiment has the consequence that the effective length of the control bar 45 during the pivot movement of the base part 19 varies between the inwardly folded base position I and the outwardly folded position of use III, i.e. the connection point between the control bar 45 and the two-armed swivel lever 41 is more or less remote from the pivot axis 25 of the base part 19 in dependence on the angular position of the base part 19. The position of the swivel lever 41 is consequently also dependent on the pivot position of the base part 19. The swivel lever 41 is supported at the base part 19 rotatable about an axis of rotation 43, with the axis of rotation 43 extending perpendicular to the pivot axis 25 and perpendicular to the support surface defined by the base part 19.

Due to the relative arrangement of the pivot axis 25 and of the adjustment axis 39, the effective length of the control bar 45 is at a maximum when the base part 19 extends in parallel with the plane defined by the two axes 25, 39. This is the case in the intermediate position II when the clearance between the floor and the front edge of the seat part 13 comes into play. In this intermediate position II, due to the above-explained adjustment of the seat part 13, i.e. the so-called seat lowering, its front marginal region is additionally raised with respect to the base position I (FIG. 2). Since the pivot axis 25 of the base part 19 is located in the region of the front edge of the seat part 13, the clearance is increased by the seat part adjustment or the seat lowering.

Figure 3:
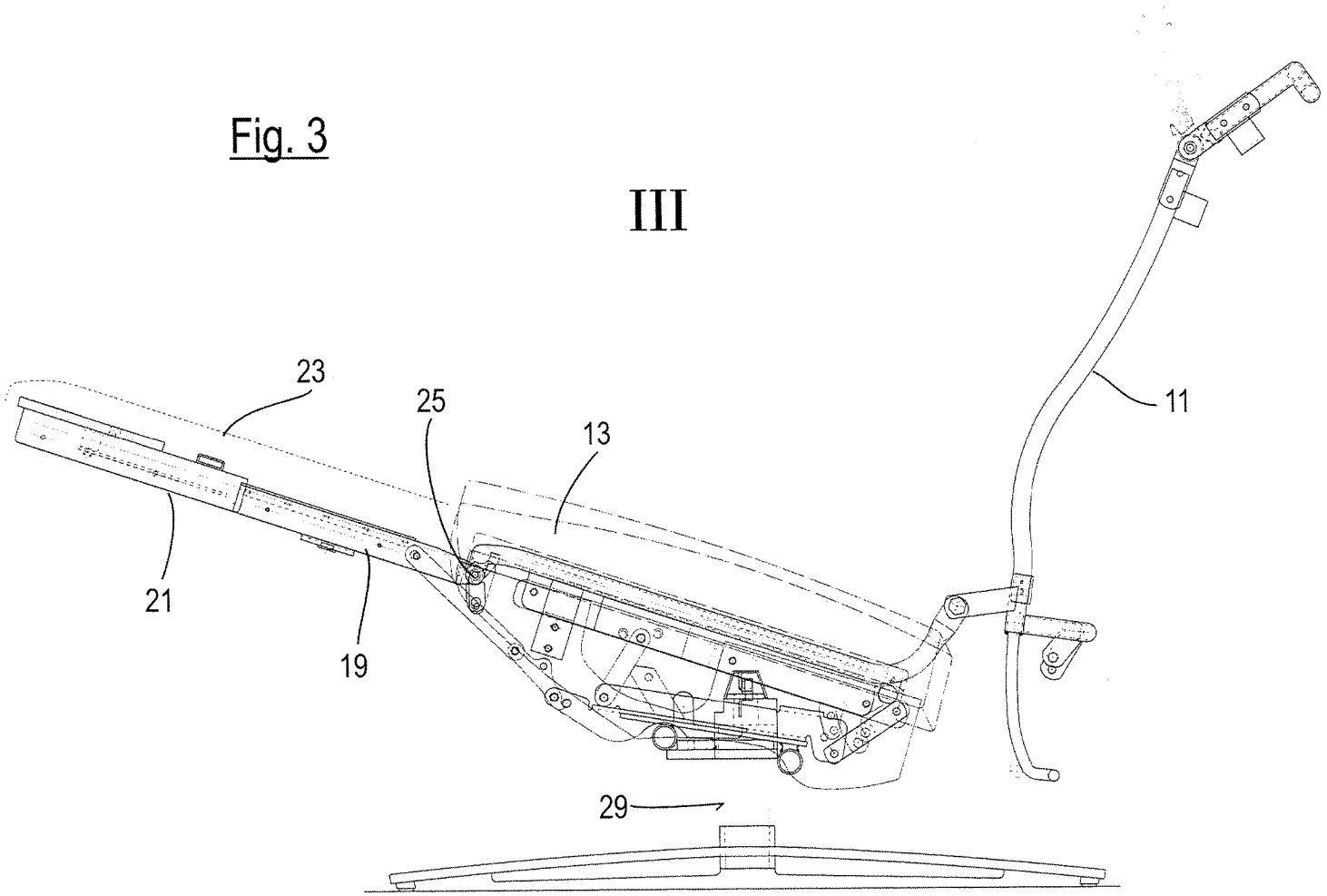
FIG. 3 shows a side view of the furniture in accordance with the invention in the position of use III.
Figure 4:
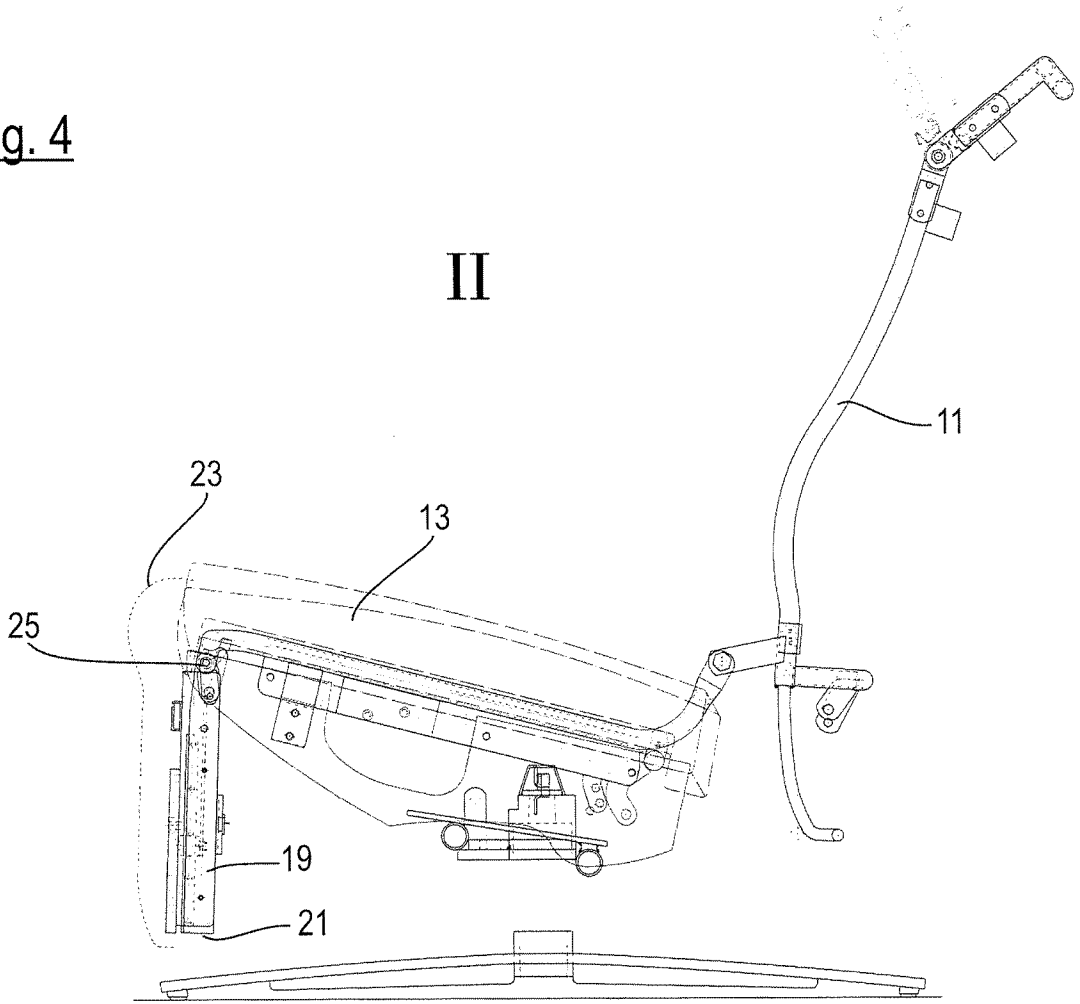
FIG. 4 shows a side view of the furniture in accordance with the invention in the intermediate position II.
Figure 5:
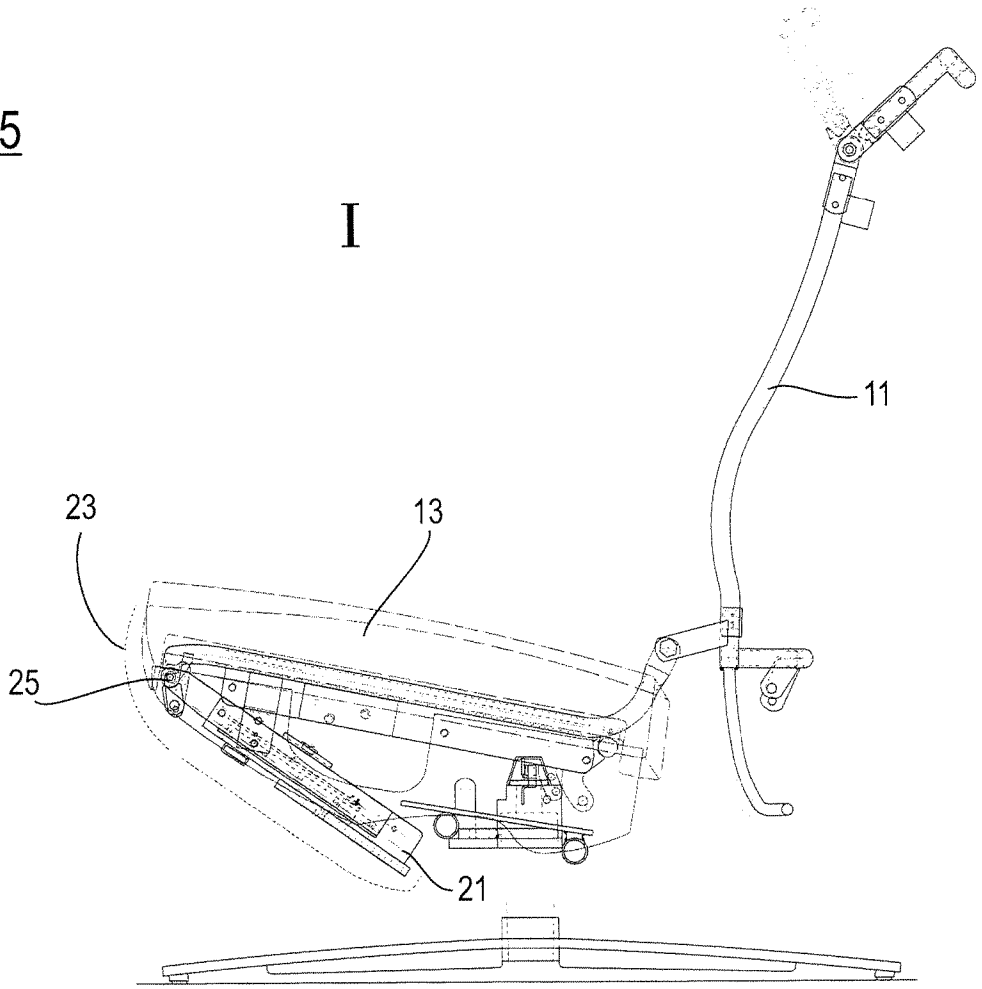
FIG. 5 shows a side view of the furniture in accordance with the invention in the base position 1.

When the base part 19 is folded further inwardly or is folded further outwardly with respect to the explained intermediate position II, the effective length of the control bar 45 respectively decreases. This means that the swivel lever 41 is pivoted outwardly out of the extreme position II—counter-clockwise in the upper representation of FIG. 6—both in the inwardly folded base position I and in the outwardly folded position of use III. Since the swivel lever 41 is coupled to the inwardly and outwardly movable extension 21 of the footrest via a further lever 49, this embodiment has the consequence that said extension is moved out more or less outside the intermediate position II with a maximally inwardly moved extension 21. In the position of use III in which the footrest is completely outwardly folded, the extension 21 is located in its position outwardly moved out the furthest. In the base position II with a footrest folded inwardly by a maximum distance, the extension 21 is likewise moved out, but to a lesser degree than in the outwardly folded position of use III. This can be seen from the upper representation in FIG. 6, from the overview representation of FIG. 2 and from a comparison of the individual representations in FIGS. 3, 4, and 5. The extension 21 is, for example, moved out approximately 5 cm with respect to the intermediate position II in the base position I. This is sufficient to eliminate a disturbing fall of the folds of the cover or of the upholstery 23 on the pivoting into the base position I, as can be seen from a comparison of FIGS. 4 and 5. A fall of the folds of the cover or of the upholstery 23 is indicated in FIG. 4.

The pivot movement of the base part 19 is consequently converted into the sliding movement of the extension 21 relative to the base part 19 by means of the control member 45 and the conversion member 47 formed in the embodiment shown by the swivel lever 41 and the further lever 49.

While the adjustment of the seat part 13 takes place by means of the motor 27 in the explained embodiment, a manual adjustability can alternatively also be provided, for example via a mechanism that makes it possible to bring about the explained seat lowering solely by a weight transfer of a user sitting on the piece of furniture, which then in turn automatically results in the outward pivoting or in the outward folding of the footrest and consequently again automatically effects the moving out of the extension 21 relative to the base part 19 of the footrest.

REFERENCE NUMERAL LIST

11 back part
13 seat part
15 footrest arrangement
17 frame
19 base part
21 extension
23 cover or upholstery
25 pivot axis of the footrest or of the base part
27 drive, motor
29 carrier
31 front pivot lever arrangement
33 rear pivot lever arrangement
35 pivot mechanism
37 adjustment arrangement
39 adjustment axis
41 swivel lever
43 axis of rotation
45 control member
47 conversion member
49 lever
51 foot
53 connecting rod arrangement
55 deflection lever
56 pivot lever
57 pivot lever
59 pivot lever
61 carrier part
63 carrier part
I base position
II intermediate position
III position of use

The invention claimed is:

1. Furniture, comprising:

a back part, a seat part and an adjustable footrest arrangement that is pivotable between an inwardly folded base position beneath a seating surface of the seat part and an outwardly folded position of use relative to the seat part, the footrest arrangement comprising:

a frame that is a component of the seat part or is attached to the seat part and a footrest pivotable relative to the frame, the footrest has a base part and an extension that is movable relative to the base part between the base position and the position of use, such that the footrest is shorter in an intermediate position than in the position of use and in the base position, wherein an adjustment of the seat part is provided as the drive for the pivot movement of the footrest; and/or wherein the pivot movement of the footrest is derived from an adjustment movement of the seat part.

2. Furniture in accordance with claim 1, wherein a length of the footrest is minimal in the intermediate position.

3. Furniture in accordance with claim 1, wherein the extension is movable inwardly and movable outwardly relative to the base part.

4. Furniture in accordance with claim 1, wherein the extension is moved out less far in the base position than in the position of use.

5. Furniture in accordance with claim 1, wherein the base part and the extension are each configured in board form or comprise at least one board-shaped support element.

6. Furniture in accordance with claim 1, wherein the base part and the extension together form an at least substantially continuous support in the position of use.

7. Furniture in accordance with claim 1, wherein the footrest is provided with a continuous cover or with continuous upholstery.

8. Furniture in accordance with claim 1, wherein the footrest is extended with respect to the intermediate position in the base position such that a cover or upholstery of the footrest is tautened or tightened more than in the intermediate position.

9. Furniture in accordance with claim 1, wherein the footrest is pivotable about a pivot axis that extends in the region of a front edge of the seat part.

10. Furniture in accordance with claim 1, wherein the footrest is attached to the frame pivotable about the base part.

11. Furniture in accordance with claim 1, wherein the footrest is pivotable by means of a powered or manual drive.

12. Furniture, comprising:

a back part, a seat part that is supported at a carrier and is adjustable relative to the carrier, and an adjustable footrest arrangement that is pivotable between an inwardly folded base position beneath a seating surface of the seat part and an outwardly folded position of use relative to the seat part, the footrest arrangement comprising:

a frame that is a component of the seat part or is attached to the seat part and a footrest pivotable relative to the frame, the footrest has a base part and an extension that is movable relative to the base part between the base position and the position of use, such that the footrest is shorter in an intermediate position than in the position of use and in the base position, and a pivot mechanism is provided for inward movement and outward movement of the footrest, with the pivot mechanism being likewise coupled to the seat part, on the one hand, and being coupled to the base part of the footrest, on the other hand, and being supported at the carrier there between.

13. Furniture in accordance with claim 12, wherein an adjustment movement of the seat part coincides with the pivot movement of the footrest.

14. Furniture in accordance with claim 12, further comprising an adjustment arrangement that is arranged to adjust the position of the extension, wherein the adjustment arrangement is effective between the extension and the frame.

15. Furniture comprising, a back part, a seat part that is supported at a carrier and is adjustable relative to the carrier, and an adjustable footrest arrangement that is pivotable between an inwardly folded base position beneath a seating surface of the seat part and an outwardly folded position of use relative to the seat part, the footrest arrangement comprising:

a frame that is a component of the seat pan or is attached to the seat part and a footrest pivotable relative to the frame, the footrest has a base part and an extension that is movable relative to the base part between the base position and the position of use, such that the footrest is shorter in an intermediate position than in the position of use and in the base position, wherein the movement of the extension relative to the base part is derived from a pivot movement of the base part.

16. Furniture, comprising:

a back part, a seat part, and an adjustable footrest arrangement that is pivotable between an inwardly folded base position beneath a seating surface of the seat part and an outwardly folded position of use relative to the seat part, the footrest arrangement comprising:

a frame that is a component of the seat part or is attached to the seat part and a footrest pivotable relative to the frame, the footrest has a base part and an extension that is movable relative to the base part between the base position and the position of use, such that the footrest is shorter in an intermediate position than in the position of use and in the base position, and an adjustment arrangement that is arranged to adjust the position of the extension, the adjustment arrangement is effective between the extension and the frame, the base part is pivotable relative to the frame about a pivot axis and the adjustment arrangement is connected to the frame in an articulated manner about an adjustment axis, the adjustment arrangement comprises at least two-armed swivel lever that is connected between the frame and the extension and is attached to the base part rotatable about an axis of rotation.

17. Furniture in accordance with claim 16, wherein the pivot axis and the adjustment axis extend with a parallel offset from one another.

18. Furniture in accordance with claim 16, wherein a spacing between the pivot axis and the adjustment axis is unchanged during the pivot movement of the footrest.

19. Furniture in accordance with claim 16, wherein the pivot axis and the adjustment axis are each in a fixed position with respect to the frame.

20. Furniture in accordance with claim 16, wherein the pivot axis and the adjustment axis define a plane that extends at least substantially vertically and/or in parallel with the footrest located in the intermediate position and/or that is oriented relative to the footrest located in the intermediate position such that the adjustment arrangement sets the length of the footrest to a minimum in the intermediate position.

21. Furniture in accordance with claim 16, wherein an effective length of the adjustment arrangement varies between the base position and the position of use of the footrest.

22. Furniture in accordance with claim 16, wherein the adjustment arrangement comprises a control member that is connected to the frame and is variable in its effective length between the base position and the position of use of the footrest, and a conversion member that is connected to the base part and to the extension and is coupled to the control member and converts a change in the effective length of the control member into a movement of the extension relative to the base part.

23. Furniture, comprising:

a back part, a seat part and an adjustable footrest arrangement that is pivotable between an inwardly folded base position beneath a seating surface of the seat part and an outwardly folded position of use relative to the seat part, the footrest arrangement comprising:

a frame that is a component of the seat part or is attached to the seat part and a footrest pivotable relative to the frame, the footrest has a base part and an extension that is movable relative to the base part between the base position and the position of use, such that the footrest is shorter in an intermediate position than in the position of use and in the base position, and an adjustment arrangement that is arranged to adjust the position of the extension, the adjustment arrangement is effective between the extension and the frame, the adjustment arrangement comprising:

a control member that is connected to the frame and is variable in its effective length between the base position and the position of use of the footrest, and a conversion member that is connected to the base part and to the extension and is coupled to the control member and converts a change in the effective length of the control member into a movement of the extension relative to the base part; and the base part is pivotable relative to the frame about a pivot axis and the adjustment arrangement is connected to the frame in an articulated manner about an adjustment axis, wherein the conversion member comprises at least two-armed swivel lever that is attached to the base part rotatable about an axis of rotation.

* * * * *